United States Patent [19]

Oshita et al.

[11] 4,442,330

[45] Apr. 10, 1984

[54] PUFFER TYPE CURRENT INTERRUPTER

[75] Inventors: Youichi Oshita, Kashiwa; Shunji Sato, Hitachi; Takeshi Takahashi, Hitachiota; Kunio Hirasawa, Hitachi, all of Japan

[73] Assignee: Hitachi, Ltd., Tokyo, Japan

[21] Appl. No.: 399,820

[22] Filed: Jul. 19, 1982

[30] Foreign Application Priority Data

Aug. 12, 1981 [JP] Japan ..... 56-125236

[51] Int. Cl.[3] ..... H01H 33/70

[52] U.S. Cl. ..... 200/148 A; 200/150 G

[58] Field of Search ..... 200/148 A, 150 G

[56] References Cited

U.S. PATENT DOCUMENTS 4,009,458 2/1977 Kishi et al. ..... 200/148 A

FOREIGN PATENT DOCUMENTS 54-7175 1/1979 Japan .

369189 9/1930 United Kingdom ..... 200/148 A

*Primary Examiner*—E. A. Goldberg

*Assistant Examiner*—Morris Ginsburg

*Attorney, Agent, or Firm*—Antonelli, Terry & Wands

[57] ABSTRACT

A puffer type current interrupter employing a pair of symmetric electrodes with contact bosses provided on their confronting surfaces. An insulator nozzle is arranged such that the throat section for providing a jet of arc blasting gas is located in the periphery of the bosses. The electrode structure provides a uniform electric field between the electrodes, thereby gaining the breakdown voltage.

14 Claims, 4 Drawing Figures

PUFFER TYPE CURRENT INTERRUPTER

The present invention relates to a puffer type current interrupter and, more particularly, to a puffer type current interrupter used for interrrupting a relatively small current with a high voltage duty, such as a resistor current interrupter used in a gas-blast circuit breaker for a UHV power system.

Due to the increasing demand of power supply, the power system is growing in both transmission voltage and capacity, and a project of building a 1000 kV class UHV power system is under way in Japan. In the UHV power system, surges generated in the system must be suppressed to an extremely low voltage on account of the economized air insulation. Therefore, it seems inevitable for the circuit breaker used in the UHV power system to introduce a resistor current interrupting system in addition to the resistor closing system which is already employed in the conventional power system.

Briefly, a resistor current interrupting system includes a main current interrupter, a resistor unit, connected electrically in parallel to the main current interrupter, and a resistor current interrupter which interrupts the current flowing through the resistor after the main current interrupter has been opened. In operation for interrupting the current the contacts of the main current interrupter are opened by a suitable operating device in response to a current interrupting command so that the main current is interrupted at the zero point of the current. Here, the main current interruption causes the main current to partially transfer to the resistor circuit. Subsequently, the resistor current interrupter is opened so that the resistor current is interrupted at the zero point of the current, and the current interrupting operation is completed.

In the foregoing resistor current interrupting system, the resistor current interrupter is required to interrupt the current in the resistor circuit which is relatively small due to the current-limiting effect of the resistor. On the other hand, the interrupter must stand a high restriking voltage which is even higher than that of the main current interrupter. Thus, the resistor current interrupter is required to have a special duty of small current and high voltage interruption.

The following describes the problems of such current interrupter if constructed in accordance with the prior art puffer type current interrupters of the type described, for example, in U.S. Pat. No. 4,293,749, which comprise a breakable contact including fixed, movable electrodes, a gas compressing means made up of a generally fixed piston and a cylinder movable relative to the piston, and an insulator nozzle which guides a high pressure gas generated by the compressor to the arc produced between the electrodes.

The insulator nozzle has a throat section, in which the fixed electrode is inserted to be in contact with the movable electrode. For the gas, $SF_6$ gas which provides a satisfactory arc quenching effect, is commonly used.

The throat section provided in the insulator nozzle is restricted in its dimensions due to the gas blasting performance which affects the current interrupting ability. The fixed electrode must have a smaller outer diameter than the inner diameter of the throat section and, consequently, the fixed electrode must have an elongated configuration. Thus, the electric field caused by the high voltage which is applied immediately after the current interruption will concentrate in the tip of the elongated fixed electrode. Since, as noted above, the resistor current interrupter operates under a severe restriking voltage condition, some measure is required to weaken the electric field. One measure may be an electric field weakening shield provided around the fixed electrode. However, it must be arranged so that it is not hit by the insulator nozzle when the breaker is closed, and thus the field weakening effect is limited. The most simple method would be to provide the electrode with a larger diameter. However, this is in fact not allowed due to the above-mentioned reason.

Another method for withstanding a high restriking voltage may be to arrange a puffer type current interrupter as mentioned above, such that the current interrupting speed is enhanced so that a satisfactory inter-electrode insulation recovery characteristics are obtained against the restriking voltage. However, this needs an enormous operating force, and thus, as a practical matter, it is impossible to realize the necessary interrupting speed.

Another prior art technology for improving the inter-electrode insulation recovery characteristics is disclosed in Japanese Patent Laid-open No. 54-7175. However, this arrangement cannot avoid the concentration of electric field at the tip of the fixed electrode in the initial stage of the current interrupting operation.

Generally, in order to drive the actuator of the resistor current interrupter with small driving power and also to achieve better recovery characteristics at a low current interrupting speed, it is required to make the electrode into a configuration which causes less concentration of the electric field even at its position immediately after separation of the contact where the distance between the electrodes is small and the most severe concentration of electric field should occur between the electrodes.

It is an object of the present invention to provide a puffer type current interrupter having high recovery voltage characteristics.

It is another object of the invention to provide a puffer type current interrupter having electrodes which provide high recovery voltage characteristics.

It is still another object of the invention to provide a puffer type current interrupter having an improved insulator nozzle which provides high recovery voltage characteristics.

To this end, the current interrupter according to the invention employs a pair of symmetrically shaped electrodes, with their confronting surfaces being provided with bosses which come to contact with each other, and the throat of an insulation nozzle is located in a periphery of the bosses. In such electrode arrangement, a uniform electric field is created between the electrodes, providing high recovery voltage characteristics.

According to the present invention, the current interruptor includes a pair of electrodes, with confronting surfaces thereof being formed in a substantially symmetric shape and with confronting portions thereof provided with contact bosses. A gas compressing means compresses arc blasting gas in response to a contacts opening operation of the electrodes, with an insulator nozzle being provided for covering one of the electrodes. The insulator nozzle includes a throat positioned in the periphery of said bosses when said electrodes are in a closed contacts state, with the nozzle conducting the blasting gas supplied from said gas compressing means to an arc produced between the electrodes. A spring means is provided for at least one of the electrodes for providing a contact pressure between the electrodes.

The above and other features will be clear from the following description of the embodiments of the present invention with reference to the accompanying drawings in which.

Figure 1:
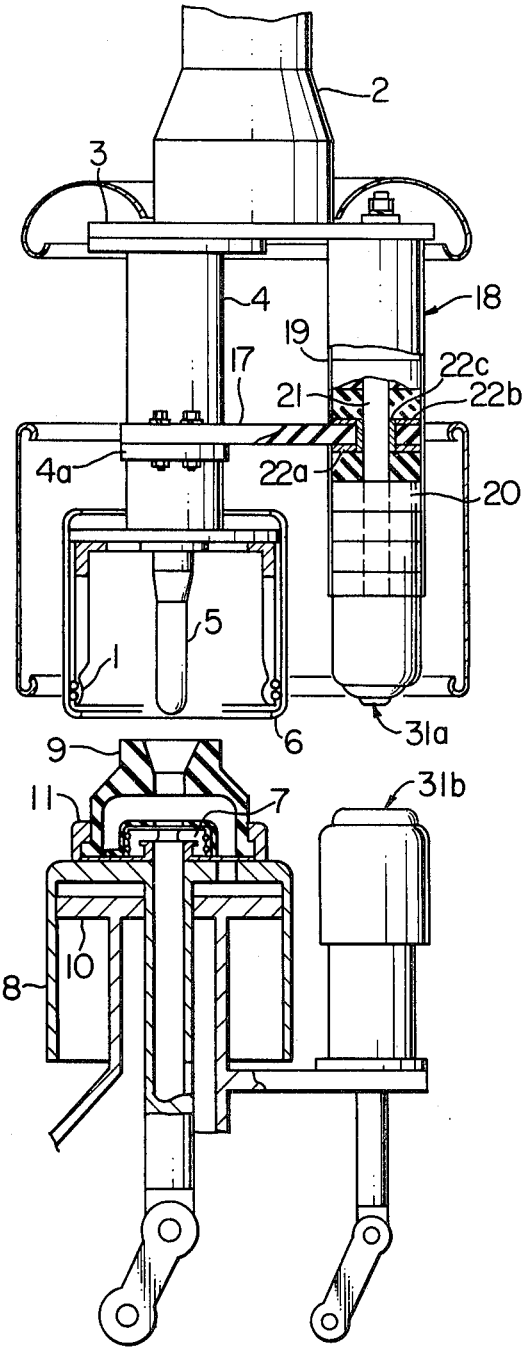
FIG. 1 is a longitudinal partial cross-sectional view of the gas-blast circuit breaker employing the present invention.

As shown in FIG. 1, a puffer type circuit breaker is accommodated within a closed container (not shown) filled with $SF_6$ gas, with one end of an insulation supporter 2 being fixed to an interior wall of the container and a second end connected, through a supporting plate 3, to a supporting conductor 4. A fixed arc contact 5, a fixed main contact 1, and a cylindrical shield 6 for weakening the electric field are concentrically mounted on the supporting conductor 4. A movable arc contact 7, confronting the fixed arc, contact 5, is mounted on a cylinder 8 which is slidably supported by a fixed piston 10. An insulator nozzle 9, which covers the movable arc contact 7, is secured on the cylinder 8 by a clamp 11 which serves as the movable main contact. The cylinder 8 and piston 10 constitute a gas compressing means which compresses the gas and provides a blast of gas through the nozzle 9 to the arc between the arc contacts 5, 7 in response to the opening operation of the arc contacts 5, 7. The portions connected with the movable arc contact 7 constitute a moving member of the current interrupter.

The current interrupter unit in the above-mentioned arrangement is connected electrically in parallel to a current interrupting resistor unit generally designated by the reference numeral 18. The current interrupting resistor unit 18 is arranged to connect a resistor into the main circuit and then to cut off the current flowing through the resistor after the main contacts are opened. The current is relatively small since it is limited by the resistor, while the voltage appearing betweeen the electrodes following the current interruption is relatively high.

The supporting conductor 4 is provided with a holder 4*a*, to which coupled is an insulator arm 17. One purpose of the insulator arm 17 is to support the resistor unit 18 at its mid portion. The resistor unit 18 includes a plurality of annular resistor elements 20 which are stacked in an insulation cylinder 19 and supported by an insulator bar 21 extending therethrough. The upper most resistor element 20 of the resistor unit 18 is connected electrically and mechanically to the supporting conductor 4 by the supporting plate 3. In assembling the resistor unit 18 on the insulator arm 17, the resistor elements 20 are stacked on the insulator bar 21, a conductive plate 22*a* is screwed to an annular member 22*c* and the so assembled elements are mounted at, the insulator arm 17. Further resistor elements 20 are stacked on the conductive plate 22*b* by being inserted on the insulator bar 21, and, finally, a conductive plate 22*b* is screwed to the annular member 22*c*. A fixed resistor contact device generally designated by the reference numeral 31*a* is formed at the bottom end of the insulator bar 21, with a movable contact device generally designated by the reference numeral 31*b*, arranged in parallel to the cylinder 8 of the main current interrupter being disposed so as to confront the fixed resistor contact device 31*a*. The movable contact device 31*b* is operated by a drive mechanism (not shown) so that the contacts are selectively opened or closed. The drive mechanism may be common to the drive mechanism for operating the cylinder 8 of the main current interrupter, or may be provided independently. In any case, the resistor contact device is adapted to open after the main current interrupter has been opened so as to cut off the current flowing through the resistor unit 18.

Figure 2:
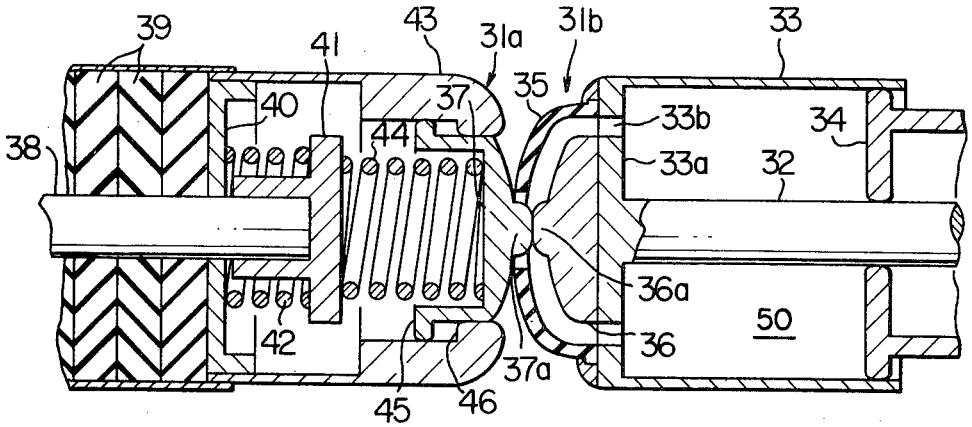
FIG. 2 is a cross-sectional view, on an enlarged scale, of a resistor contact device of the breaker of FIG. 1.

As shown in FIG. 2, a cylinder 33 is secured on a shaft 32 which is connected to the drive mechanism (not shown). A fixed piston 34 is slidably inserted in the cylinder 33 to form a puffer chamber 50. When the cylinder 33 moves to the right side, as seen in FIG. 2, the gas inside the puffer chamber 50 is compressed. Gas blasting holes 33*b* are formed in an end plate 33*a* of the cylinder 33, and an insulator nozzle 35 is fixed on the end plate 33*a* so as to surround the blasting holes 33*b*. A movable electrode 36 is fixed on the end plate 33*a* inside the insulator nozzle 35. The movable electrode 36 confronts a fixed electrode 37, and the confronting surfaces of both electrodes 36, 37 are shaped symmetrically. Both electrodes 36, 37 have respective bosses 36*a* and 37*a* at the center which serve as electrical contacts. A certain number of resistor elements 39 are placed on an insulator bar 38 which is secured at one end to a supporting member (not shown). The right-most resistor element 39 is in contact with an end plate 40. Between the end plate 40, and an end member 41 secured to the end of the insulator bar 38, there is placed a spring 42 which provides a contact pressure for the resistor elements 39. A fixed shield cylinder 43 is secured to the end plate 40, and the fixed shield cylinder 43 surrounds the end member 41 and the fixed electrode 37. A compression spring 44 is placed between the end member 41 and the fixed electrode 37 so that the fixed electrode 37 is in pressing contact with the movable electrode 36. However, when the flange 45 comes into abutment with the stopper 46, the fixed electrode 37 no longer moves toward the movable electrode 36.

What should be noticed in the arrangement of FIG. 2 is the structure of the confronting portions of the electrodes 36 and 37 for weakening the electric field, and the arrangement of the insulator nozzle 35. When the fixed electrode 37 is pushed out by the spring 44 until the flange 45 comes into abutment with the stopper 46, the surfaces of the fixed shield cylinder 43 and the fixed electrode 37 form a continuous spherical surface. The throat of the insulator nozzle 35 is located along the periphery of the bosses 36*a* and 37*a*. Thus, the confronting surfaces of the fixed resistor contact device 31*a* and the movable resistor contact device 31*b* have a symmetrical shape.

The contact devices 31*a* and 31*b* are preferably made to have respective outer surface configurations at the parts opposed to each other which are determined by taking into consideration the electric field effects and also the manufacturing processes. For example, these surfaces may be formed to be facing to each other with circular portions, while the bosses 36*a* and 37*a* are made to have substantially equal and small heights.

The compressed gas in the puffer chamber 50 is led out through the blasting holes 33*b* and released from the throat of the insulator nozzle 35. At this time the arc between the electrodes 36 and 37 is extinguished by the gas stream. In order to form the gas stream, an appropriate flow path area is formed between the movable electrode 36 and the interior wall of the insulator nozzle 35. To this end, the insulator nozzle 35 projects toward the fixed electrode 37, while the bosses 36*a* and 37*a* are made with an increased axial dimension.

Figure 3:
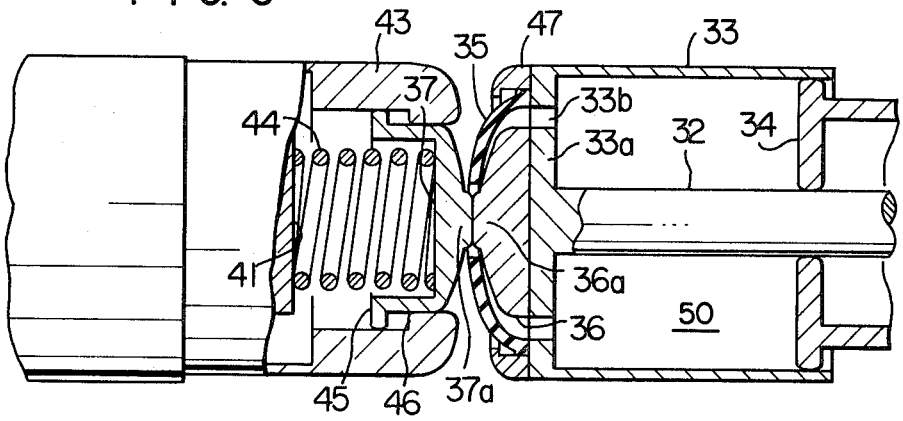
FIG. 3 is a longitudinal cross-sectional view showing another embodiment of the puffer type current interrupter according to the invention.
Figure 4:
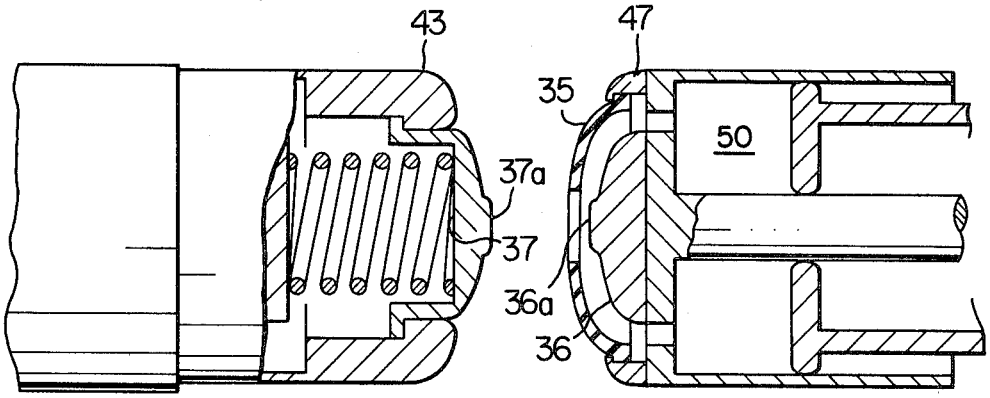
FIG. 4 is a longitudinal cross-sectional view showing the opening state of the puffer type current interrupter shown in FIG. 3.

In FIGS. 3 and 4, the bosses 36*a*, 37*a* have a smaller axial dimension and this embodiment differs from the embodiment of FIG. 2 in the structure for mounting the insulator nozzle 35. The insulator nozzle 35 is allowed to move for a certain distance in the operating direction of the electrodes 36 and 37. For this purpose, a sliding space is provided inside a fixture 47 which mounts the insulator nozzle 35 on the end plate 33*a* of the cylinder 33. This arrangement is effective, on one hand, to prevent the fixed electrode 37 from hitting the insulator nozzle 35, that would occur if the axial dimension of the boss 37*a* of the fixed electrode 37 were simply reduced in the arrangement of FIG. 2, and also effective, on the other hand, to provide an adequate gas flow path area inside the insulator nozzle 35, which could not be achieved, if the insulator nozzle 35 were placed nearer to the movable electrode 36 in order to avoid being hit by the fixed electrode 37 as mentioned above. The above-mentioned conflicting requirements can be met by the arrangement of a movable insulator nozzle 35.

In the closed state of the contacts shown in FIG. 3, the insulator nozzle 35 is located on the side of the movable electrode 36, thus allowing the bosses 36*a* and 37*a* of the electrodes 36 and 37 to have a very small axial dimension.

From this initial state, when the movable electrode 36 is moved in the opening direction, the gas in the puffer chamber 50 is compressed, then the electrodes 36 and 37 are separated. During the movement, the insulator nozzle 35 is driven leftward by the compressed gas from the puffer chamber 50. At a time when a gas blow is needed between the electrodes 36 and 37, as shown in FIG. 4, the insulator nozzle 35 is located on the side of the fixed electrode 37, providing a sufficient flow path area between the interior wall of the insulator nozzle 35 and the movable electrode 36. As can be seen in FIG. 4, after the contacts have been opened, the electrode 36 and its associated equi-potential components of the fixed side are substantially symmetrical in shape with those of the moving side. Therefore, electric fields are produced with substantially equal intensity between the electrodes 36, 37, and this provides high recovery voltage characteristics.

Such recovery voltage characteristics are accomplished by the provision of the electrodes 36 and 37 having the substantially same shape of the confronting surfaces with their contacts formed as the bosses 36*a* and 37*a* provided on the electrodes, and the insulator nozzle 35 having a throat which surrounds the boss. Various modifications are possible for the shapes of the fixed shielding cylinder 43 and the fixture 47 provided around the electrodes 36 and 37 for compensating the electric field. Due to a considerable reduction in the axial dimension of the bosses 36*a* and 37*a* by employment of the movable insulator nozzle 35, similar breakdown voltage characteristics can be expected for the arrangement where only one electrode is provided with a boss and another electrode is shaped in a spherical surface.

The electrodes 36 and 37 must have a certain contact pressure, as they conduct the current through the resistor unit 39. In the foregoing embodiments, the spring 44 is provided on the side of the fixed electrode 37. However, the spring may otherwise be provided on the side of the movable electrode 36, and in this case, the boss 36*a* is made separately from the electrode 36 so that it is spring biased. The boss 36*a* must have an axial dimension so as to keep the spatial relationship with the moving electrode 36 when the contacts are opened as shown in FIGS. 2 and 3.

Although the resistor current interrupter has been described, the present invention can be applied to any current interrupter with high recovery voltage which needs a gas compressing means and insulator nozzle for blasting gas.

We claim:

1. A puffer type current interrupter including current interrupting means comprising:

a pair of electrodes having confronting surfaces formed in a substantially symmetric shape;

a pair of bosses respectively integrally formed on the confronting surfaces of said electrodes and adapted to provide electrical contact between said electrodes, said bosses having substantially equal heights with respect to the respective confronting surfaces;

an insulator nozzle means for covering one of said pair of electrodes and having a throat which is capable of receiving the boss of the other of said pair of electrodes;

a gas flow path formed between said insulator nozzle means and said one of said pair of electrodes; and means responsive to an opening operation of said electrodes for compressing arc-quenching gas and blasting the compressed gas through said gas flow path to extinguish an arc produced betweeen said bosses when said electrodes are opened.

2. A puffer type current interrupter according to claim 1, wherein said throat is positioned to receive the boss of the other of said pair of electrodes when said electrodes are in an electrically closed state.

3. A puffer type current interrupter according to claim 1 further comprising resistor means electrically connected in series to one of said electrodes.

4. A puffer type current interrupter including current interrupting means comprising:

a first and second electrodes having confronting surfaces formed in a substantially symmetric shape, at least one of said electrodes having a contact boss which comes into contact with the second electrode;

gas compressing means which compresses arc blasting gas in response to a contact opening operation of said first electrode;

an insulator nozzle provided to cover said first electrode and having a throat which is positioned in the periphery of said contact boss when said electrodes are in a closed-contact state, said insulator nozzle conducting the blasting gas supplied from said gas compressing means to an arc produced between said electrodes;

means for movably supporting said insulator nozzle so that said nozzle moves for a certain distance toward said second electrode by the action of the arc blasting gas supplied from said gas compressing means; and spring means provided for at least one of said electrodes for providing a contact pressure between said electrodes.

5. A puffer type current interrupter according to claim 4, wherein a contact boss is formed on each of said electrodes, and said throat of said insulator nozzle positioned in the periphery of the contact bosses when said electrodes are in a closed-contact state.

6. A puffer type current interrupter according to claim 4, wherein said insulator nozzle forms a gas flow path from said gas compressing means by moving itself for a certain distance toward said second electrode.

7. A puffer type current interrupter according to claim 2, wherein spring means are associated with at least one of said pair of electrodes for providing a constant pressure between the electrodes.

8. A puffer type current interrupter according to claim 1, wherein the confronting surfaces of the pair of electrodes are generally circular.

9. A puffer type current interrupter comprising:

first and second electrodes having confronting surfaces formed in a generally circular configuration and substantially symmetrical with respect to each other;

first and second bosses respectively integrally formed to central portions of said confronting surfaces of said first and second electrodes and adapted to provide an electrical contact between said electrodes, said bosses having substantially equal heights with respect to the respective confronting surfaces;

an insulator nozzle disposed to cover said first electrode and having a throat which is capable of receiving said second boss;

a gas flow path formed between said insulator nozzle and said first electrode;

means responsive to an opening operation of said electrodes for compressing arc-quenching gas and blasting the compressed gas through said gas flow path towards an arc produced between said bosses when said electrodes are opened; and means for movably supporting said insulator nozzle so that said nozzle moves a predetermined distance away from said first boss by the blasting action of said compressed gas.

10. A puffer type current interrupter according to claim 9, wherein said throat is disposed so as to surround a periphery of said first and second bosses when said electrodes are in an electrically closed state.

11. A puffer type current interrupter according to claim 9, wherein said gas flow path is dimensioned so as to provide a necessary blasting gas flow when said insulator nozzle has moved said predetermined distance.

12. A puffer type current interrupter according to claim 1, wherein said current interrupting means includes a main current interrupter means for interrupting a main current and a resistor current interrupter means connected electrically in parallel to the main current interrupter means for interrupting a current flow through resistor means after the main current interrupter means has been opened, said resistor current interrupter means including said pair of electrodes.

13. A puffer type curent interrupter according to claim 12, wherein the resistor means includes a plurality of individual resistors electrically connected to one of said pair of electrodes.

14. A puffer type current interrupter according to claim 4, wherein said current interrupting means includes a main current interrupter means for interrupting a main current and a resistor current interrupter means connected electrically in parallel to the main current interrupter means for interrupting a current flow through resistor means after the main current interrupter means has been opened, said resistor current interrupter means including said electrodes.

* * * * *